United States Patent [19]

Cassagnes et al.

[11] 4,364,176

[45] Dec. 21, 1982

[54] DRAWING APPLIANCE

[75] Inventors: Andre J. Cassagnes, Vitry sur Seine, France; Irving C. Dudley, Milford, Mass.

[73] Assignee: Hasbro Industries, Inc., Pawtucket, R.I. ; a part interest

[21] Appl. No.: 233,201

[22] Filed: Feb. 10, 1981

[30] Foreign Application Priority Data

Feb. 14, 1980 [FR] France ..... 80 03306

[51] Int. Cl.[3] ..... B43L 13/00

[52] U.S. Cl. ..... 33/18 R; 346/21

[58] Field of Search ..... 33/18 R, 23 C; 346/21

[56] References Cited

U.S. PATENT DOCUMENTS 4,135,303 1/1979 Gresset ..... 33/18 R 4,251,920 2/1981 Cassagnes ..... 33/174 B

*Primary Examiner*—Charles E. Phillips

*Attorney, Agent, or Firm*—Salter & Michaelson

[57] ABSTRACT

A drawing appliance is disclosed of the type that includes a screen to which a powdered substance adheres, a stylus being used to trace lines through the powdered substance, and a mechanism being provided that enables the stylus to be withdrawn from engagement with the screen so that movement of the stylus to another location on the screen does not result in unnecessary tracing of lines on the screen.

2 Claims, 6 Drawing Figures

DRAWING APPLIANCE

BACKGROUND AND SUMMARY OF THE INVENTION

In the U.S. Patent Application Ser. No. 43,361 filed May 29, 1979, a drawing appliance has been described that includes as a combination a fixed but replaceable stencil that is provided with a cutting of a certain shape intended to serve as a guide of the tracing part of stylus and with a support capable of receiving the tracings made by the tracing part, this support being rotatable so as to be able to be angularly displaced by successive steps.

In accordance with a particular form of the invention, the support intended to receive the tracings of the tracing part consists of a translucent screen that forms the upper part of a tight chamber containing a dust-like matter that is capable of adhering to the translucent screen, while the tracing part consists of a movable stylus located within the chamber and that is resiliently supported on the inner surface of the screen. The tracing stylus axially traverses the chamber bottom in a tight but articulate manner by control of the bottom end thereof which is connected by an appropriate system of rods to a control member of a "joy stick" type that is capable of being guided by the stencil. The tight chamber and the rod system are located on the same hollow housing in which light is emitted by the controlling part, and the housing also defines a repository for the replaceable stencil.

Such an appliance permits various kinds of more or less complicated geometrical forms as based on one or several stencils provided with cuttings of elementary shapes to be reproduced in a simple and ingenious manner. It is also possible to use the appliance for the direct production of drawings, without the use of intermediate stencils; however, in the latter case, the fact that the stylus tip is constantly supported by the inner surface of the screen constitutes a serious drawback because in such a case one cannot avoid the presence of the unsightly connecting lines between the different elements of the drawing.

The present invention is intended to cope with such a drawback, and to this effect, the invention is applied to a drawing appliance of the aforementioned type, characterized essentially by the circumstance that there is provided means for a temporary removal of the stylus point from the inner surface of the screen.

In a particular form of the invention a stylus rod system is supported by at least one movable bearing that is capable of being displaced under influence of a controlling lever, one end of which is accessible exteriorly of the device through an opening in the housing thereof.

It is understood that in this manner, by simply displacing a bearing of the rod system, the removal of the stylus from the screen can be accomplished without hindering the functioning of the rod system. It is therefore possible in this manner to place the stylus in any location with respect to the screen without creating tracings while moving the stylus, which further increases the application possibilities of the appliance, that is, permitting more complicated drawings of a better quality to be created.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
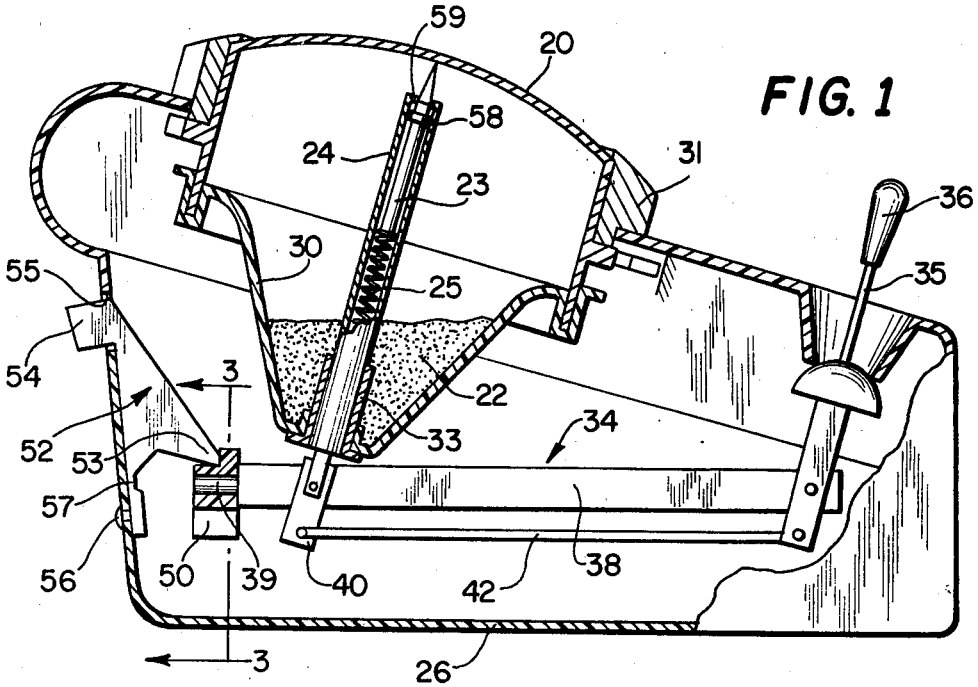
FIG. 1 is a sectional view of the invention showing the stylus in the screen engaging position and illustrating one form of a stylus retracting device.

With reference to the drawings, it is noted that the reference numerals are the same as utilized in the aforesaid U.S. application, which could be therefore, if needed, referred to in order to have more information concerning the operating mode of the appliance as described hereinafter.

Figure 2:
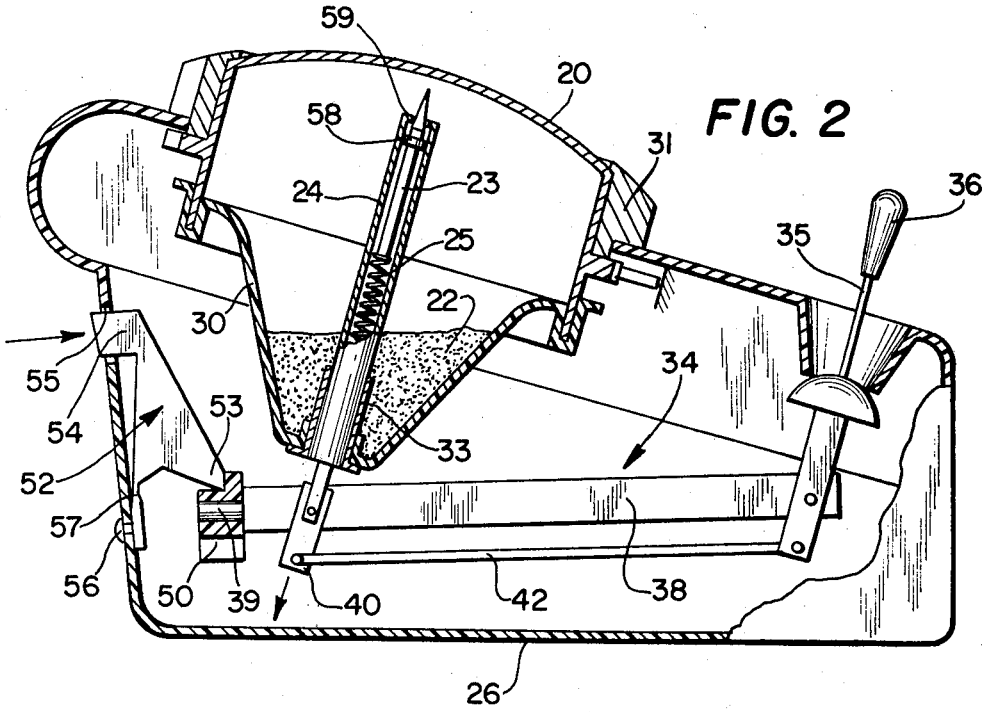
FIG. 2 is a sectional view similar to FIG. 1, showing the stylus in the retracted position.
Figure 3:
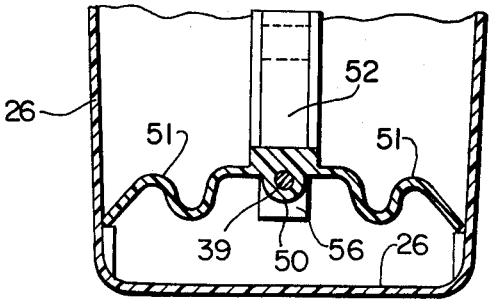
FIG. 3 is a sectional view taken along line 3—3 in FIG. 1.

Referring now to FIGS. 1–3, one form of the invention is illustrated and includes a rod system generally indicated at 34 that consists of a controlling part 35 and a tube 24 which supports a pen or stylus 23 which, as will be described, is displaceable vertically. For this purpose a pivot is joined to a rigid frame 38 that is located on the side of a transversal part 40. The pivot 39 is also rigidly locked relative to the tube 24 and is rotatably mounted within a movable bearing 50. The tube 24 extends interiorly of a sealed enclosure defined by a flexible conically-shaped cup 30, through the lower end of which a sleeve 33 extends in sealing engagement, the tube 24 being received in the sleeve 33. The cup 30 is secured to an upper cover, the outermost portion of which defines a screen 20. A circular flange or ring 31 engages the upper cover for securing it to the box 26.

As shown in FIG. 3, the movable bearing 50 consists of a plastic part cast with two relatively thin lateral wings 51 that define a spring, te ends of which are fastened to the sides of the box 26. The bearing 50 is thus elastically displaced due to the deformability of the wings 51, which are moreover preflexed so as to increase their deformability.

The displacement of the bearing 50 is accomplished through the use of a control generally indicated at lever 52, which is constructed of a plastic material, and which includes an end 53 that rests directly on the bearing 50, while the other end thereof that is shaped as a handling button 54 is accessible from the outside of the housing through an opening 55 located at the rear of the box 26. The lever 52 is attached to the rear wall of the box 26 by a rivet 56 to which it is connected by a thinner part 57 that defines a hinge.

In operation, by pushing on the handling button 54, the lever 52 tilts about its articulation point 54, which causes the end 53 to urge the bearing 50 downwardly against the action of the elastic wings 51. Under this action the rod system 34 is lowered and draws the tube 24 supporting the stylus 23 downwardly. The stylus 23 as assembled glides in the tube 24 and normally rests on the inner surface of the screen 20 as urged thereto by the spring 25, the displacement thereof being controlled by a collar 58 that at the limit of its travel engages a shoulder 59 that is located at the outer end of the tube 24.

The stylus 23 is thus displaced from the screen 20 and may be moved to any location on the screen without marking or tracing any lines thereon, by simply manipulating the control part 35 by means of the handle 36 provided therefor.

When the pressure exerted on the handling button 54 is released, the bearing 50 returns to its original position under the action of the elastic wings 51, and the stylus 23 is again urged into contact with the inner surface of the screen 20 and is movable thereacross by manipulation of the handle 36, the lines as traced by the stylus 23 being externally visible on the screen 20 by the removal of the adhering powder 22 therefrom.

The appliance in conformity with the present invention thus permits any kind of drawing to be created, even the most complicated ones, without the production of any superfluous connecting lines.

Figure 4:
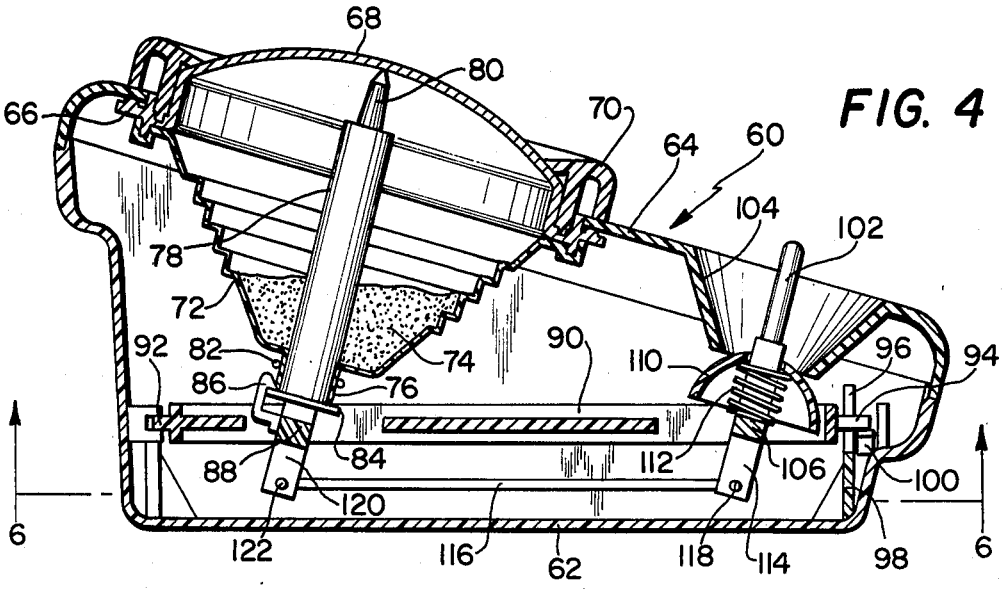
FIG. 4 is a sectional view of the invention illustrating a modified form of a stylus retracting device, and wherein the stylus is located in the screen engaging position.
Figure 5:
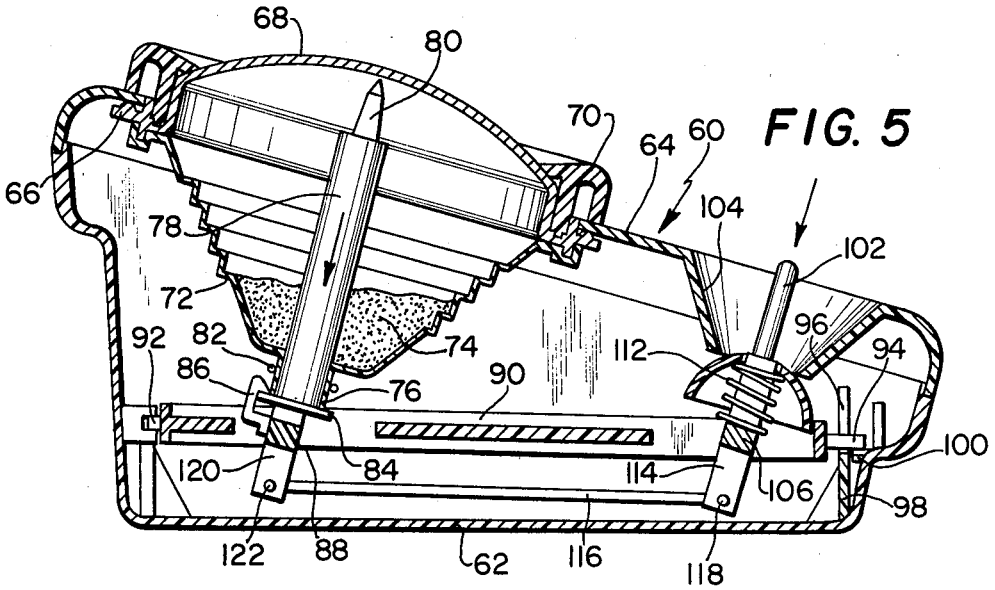
FIG. 5 is a view similar to FIG. 4, showing the stylus in the retracted position.
Figure 6:
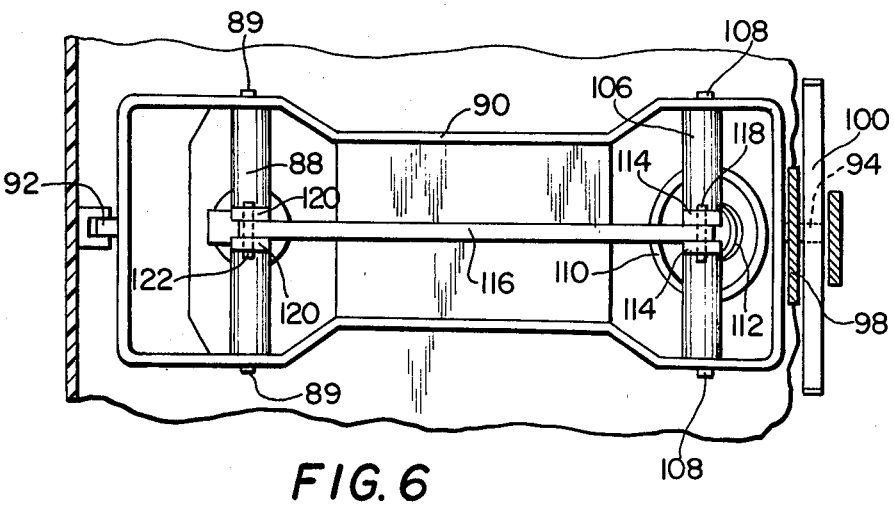
FIG. 6 is a sectional view taken along line 6—6 in FIG. 4.

Referring now to FIGS. 4–6, a modified form of the invention is illustrated and includes a housing generally indicated at 60 that is defined by a lower box portion 62 on which an upper portion 64 is secured. Formed in the upper portion 64 is a circular opening that receives an annular flange 66 of a convexly-shaped screen 68. A circular flange or ring 70 engages the flange 66 for securing it in place. Joined to the flange 66 of the screen 68 is a conically-shaped flexible cup member 72 that cooperates with the screen 68 to define a sealed enclosure for receiving an adhering powder 74 therein. Extending through a lower back section 76 of the cup member 72 is a tubular member 78 which receives a stylus 80 therein, the stylus 80 terminating in a point that is engageable with the inner surface of the screen 68. A sealing ring 82 extends around the neck section 76 and seals the interior of the cup member 72.

Fixed to the lowermost end of the tubular member 78 is a ring 84 that is engageable by a hook member 86 that is in turn fixed in a crossbar 88. The crossbar 88 is secured to the outer ends thereof at 89 to a frame that is formed as part of a lever 90. The lever 90 is pivotally connected at one end to the box 62 as indicated at 92 and has a pin 94 joined to the other end that is mounted for limited vertical movement in a slot 96 that is formed in a bracket 98. The pin 94 rests on a leaf spring 100 that is securable at the ends thereof to the bottom of the box 62, the spring 100 thus normally urging the pin 94 and the lever 90 to an upper pivoted position as shown in FIG. 4, and thereby urging the stylus 80 into engagement with the inner surface of the screen 68.

A control member 102 extends through a conically-shaped recess 104 formed in the upper portion 64 and is secured at its lower end to a crossbar 106 that in turn is fixed at its outer ends to the lever 90 as indicated at 108. A hemispherical element 110 is mounted on the control member 102 for concealing the opening in the lower end of the recess 104 and provides for universal movement of the control member relative to the housing. A coil spring 112 is located around control member 102 between the hemispherical element 110 and the cross bar 106, and helps to maintain the control member 102 in the upper biased position. In order to move the stylus 80 to various positions on the screen 68, the lowermost end of the crossbar 106 is formed with spaced legs 114 that are connected to a rod 116 by a pin 118. The rod 116 is joined at the other end thereof to spaced legs 120 by pin 122, the spaced legs 120 being fixed to the crossbar 88. It is seen that any movement of the control element 102 will be translated by the lever 90 and rod 116 into a similar movement of the stylus 80 on the screen 68, thereby tracing a line thereon as the powdered material 74 is removed from the screen by the stylus.

When it is desired to move the stylus 80 from one location on the screen 68 to the other without tracing a line thereon, the control member 102 is urged inwardly as indicated in FIG. 5, which movement forces the lever 90 to pivot against the action of the leaf spring 100 on the pin 92. Since the cylinder 78 and the stylus 80 are interconnected to the lever 90, the downward pivotal movement of the lower withdraws the stylus from engagement with the screen 68. The control member 102 may then be moved universally, which movement results in a corresponding movement of the stylus through the linkage system without tracing a line on the screen. When the downward thrust on the control member 102 is released, the stylus 80 reengages the screen 68 and continued movement of the control member results in a corresponding tracing on the screen.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. In a drawing appliance comprising a housing in which a sealed enclosure is located, the outermost portion of said enclosure being defined by a translucent screen, a powdery material located in said enclosure and having adhering characteristics for adherence to said screen when placed into contact therewith, a movable stylus located in said enclosure, a control member, a linkage system interconnecting said control member to said stylus for moving said stylus across said screen to remove the powdery material therefrom and to thereby trace a line thereon, characterized in that said control member is depressible, one end of said linkage system is pivotally mounted on said housing, the other end of said linkage system is connected to said control member and is depressible therewith to pivot said linkage system and thereby remove said stylus from engagement with said screen.

2. The appliance of claim 1, further comprising spring means biasing said control member to a nondepressed position wherein said stylus is in engagement with said screen.

* * * * *